US006224451B1

(12) United States Patent
Lai

(10) Patent No.: US 6,224,451 B1
(45) Date of Patent: May 1, 2001

(54) ASSEMBLING STRUCTURE FOR MAIN WING OF A MODEL AIRPLANE

(75) Inventor: Aling Lai, Taichung (TW)

(73) Assignee: Thunder Tiger Corp., Taichung (TW)

( * ) Notice: Subject to any disclaimer, the term of this patent is extended or adjusted under 35 U.S.C. 154(b) by 0 days.

(21) Appl. No.: 09/395,341

(22) Filed: Sep. 13, 1999

(51) Int. Cl.[7] ..... A63H 27/00; A63H 33/08

(52) U.S. Cl. ..... 446/34; 446/88; 446/127; 403/294; 403/374.1

(58) Field of Search ..... 446/34, 36, 61, 446/62, 66, 87, 88, 127, 489; 403/294, 292, 374.1, 364

(56) References Cited

U.S. PATENT DOCUMENTS 235,300 * 12/1880 Sanders ..... 403/364 X
2,870,567 * 1/1959 Bergstrand ..... 446/34
3,735,524 * 5/1973 Staats et al. ..... 446/34 X
3,825,360 * 7/1974 Galich ..... 403/294
3,935,664 * 2/1976 Neuhierl ..... 446/34
5,035,382 * 7/1991 Lissaman et al. ..... 446/34 X
5,333,964 * 8/1994 Thomas ..... 403/294 X

* cited by examiner

*Primary Examiner*—D. Neal Muir
(74) *Attorney, Agent, or Firm*—Rosenberg, Klein & Lee

(57) ABSTRACT

An assembling structure for main wing of a model airplane. The main wing is composed of a left wing and a right wing. The mating faces of the left and right wings are disposed with complementary engaging seat and engaging block which are mated with each other and tightened by a conic screw. Therefore, the left wing and the right wing can be quickly firmly assembled to form the main wing. The screw can be easily untightened to quickly disassemble the left wing from the right wing for easy carriage or storage.

2 Claims, 4 Drawing Sheets

ASSEMBLING STRUCTURE FOR MAIN WING OF A MODEL AIRPLANE

BACKGROUND OF THE INVENTION

The present invention relates to an assembling structure for main wing of a model airplane, which permits the main wing to be quickly firmly assembled or disassembled for easy carriage or storage.

FIG. 4 shows a conventional assembling structure for main wing of a model airplane. The main wing 70 is composed of a left wing 71 and a right wing 72. The mating face of the right wing 72 is disposed with a connecting post 721 and a connecting plate 722. The left wing 71 is formed with a connecting socket 711 and a connecting way 712 corresponding to the connecting post 721 and the connecting plate 722 of the right wing 72. The connecting post 721 and the connecting plate 722 can be respectively fitted into the connecting socket 711 and the connecting way 712 to associate the left wing 71 with the right wing 72. An adhesive tape is wound around the periphery of the mating section of the wing face to bind the left wing 71 with the right wing 72.

When disassembled, the adhesive tape 73 must be first torn away so as to separate the left wing 71 from the right wing 72. In the case of strong adhesion of the tape 73, the left and right wings 71, 72 can be firmly associated with each other. However, it is difficult to tear away the tape 73. Reversely, in the case of weak adhesion of the tape 73, it is easy to tear away the tape 73. However, the left and right wings 71, 72 can be hardly firmly associated with each other or even will separate from each other during flying of the model airplane.

SUMMARY OF THE INVENTION

It is therefore a primary object of the present invention to provide an assembling structure for main wing of a model airplane. The main wing is composed of a left wing and a right wing. The mating faces of the left and right wings are disposed with complementary engaging seat and engaging block which are mated with each other and tightened by a conic screw. Therefore, the left wing and the right wing can be quickly firmly assembled to form the main wing. The screw can be easily untightened to quickly disassemble the left wing from the right wing for easy carriage or storage.

According to the above object, in the assembling structure for main wing of a model airplane of the present invention, the mating face of the right wing is disposed with a connecting post and an upper reverse angle connecting plate. The left wing is formed with a connecting socket and a connecting way corresponding to the connecting post and the connecting plate. At least a front section of the mating face of the right wing is disposed with a projecting engaging seat. The engaging seat is formed with a perpendicular conic hole passing through a bottom face of the right wing. A middle portion of the engaging seat is formed with an engaging recess parallel to the wing face. The left wing is formed with a receptacle corresponding to the engaging seat of the right wing. The left wing is formed with a projecting engaging block corresponding to the engaging recess of the engaging seat of the right wing. The engaging block is formed with a conic hole corresponding to the conic holes of the engaging seat and having equal coning. The conic hole of the engaging block passes through a bottom face of the left wing. When the left and right wings are mated with each other, a conic screw can be screwed into the conic holes to lock the left wing with the right wing.

The present invention can be best understood through the following description and accompanying drawings wherein:

DETAILED DESCRIPTION OF THE PREFERRED EMBODIMENT

Figure 1:
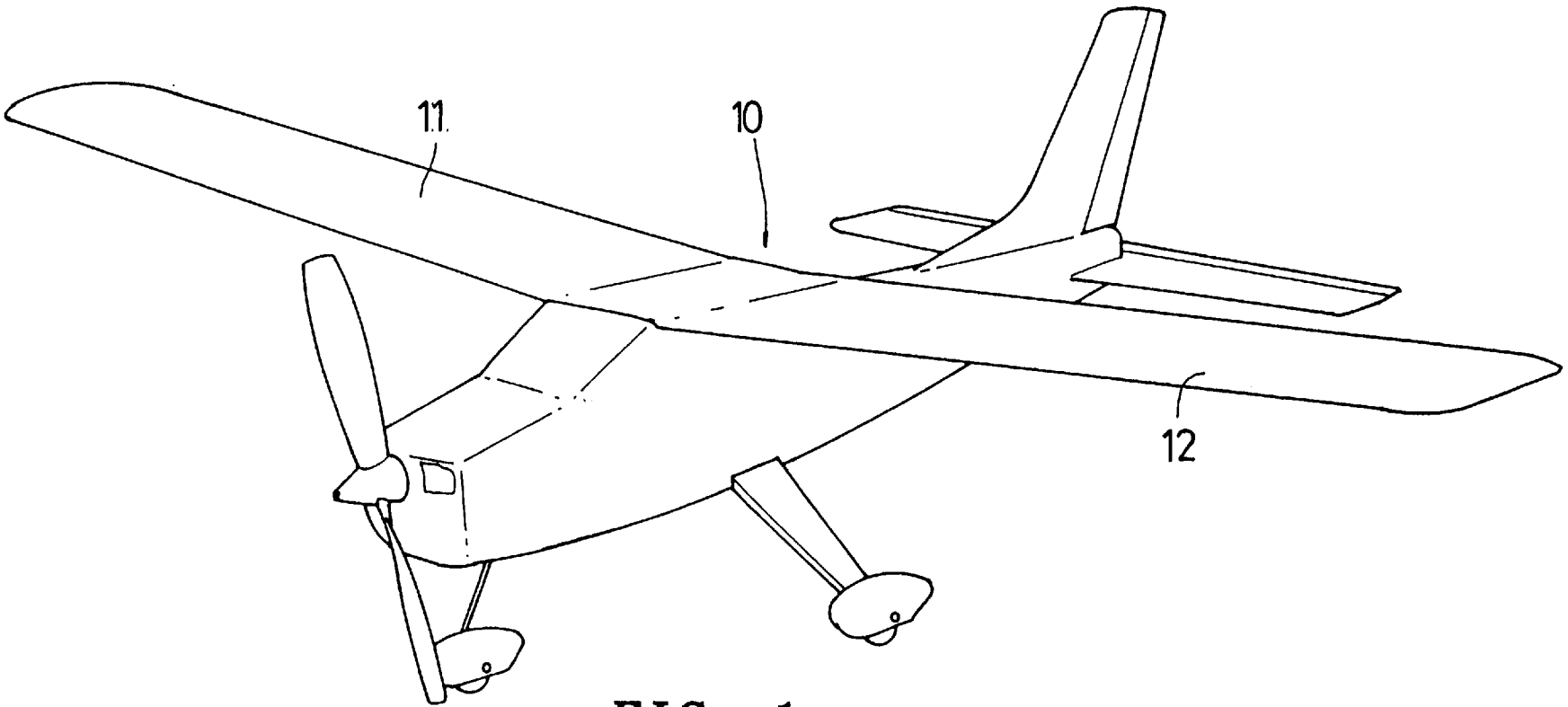
FIG. 1 is a perspective view showing that the present invention is mounted on a model airplane.
Figure 2:
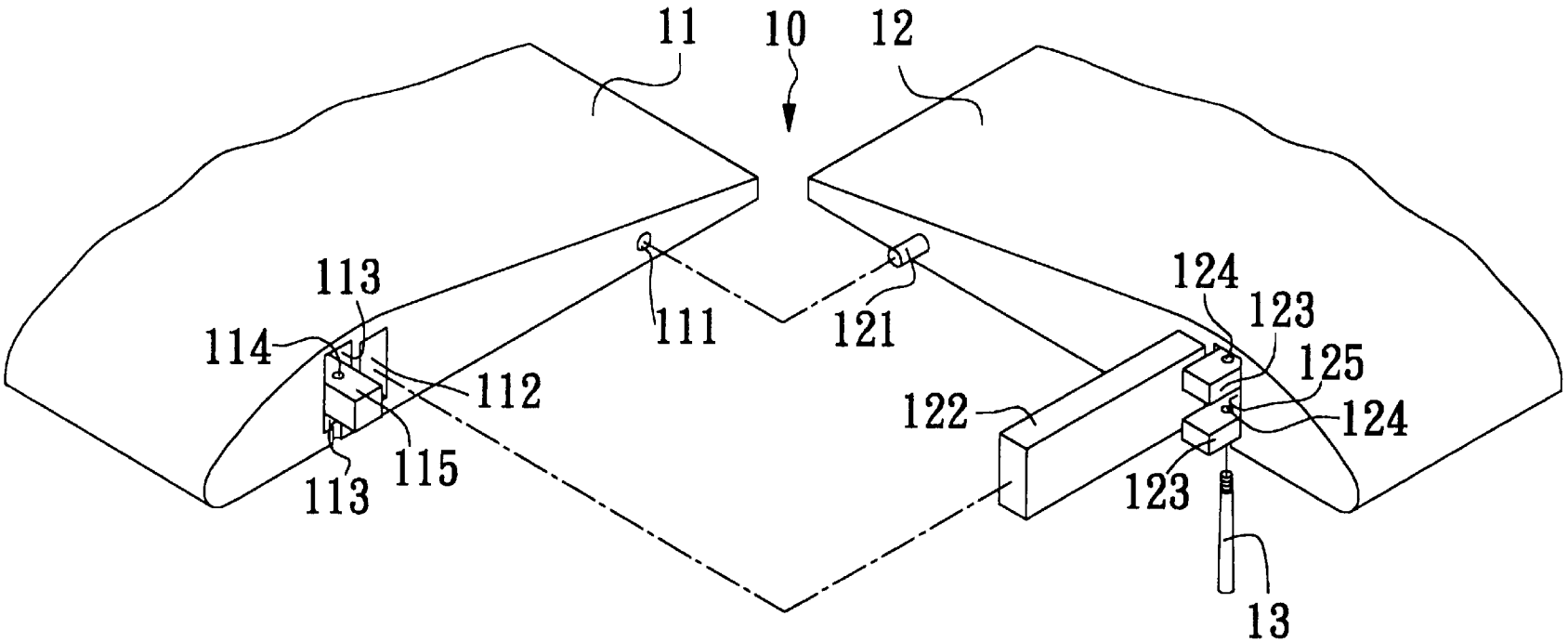
FIG. 2 is a perspective exploded view of the main wing of the present invention.
Figure 3:
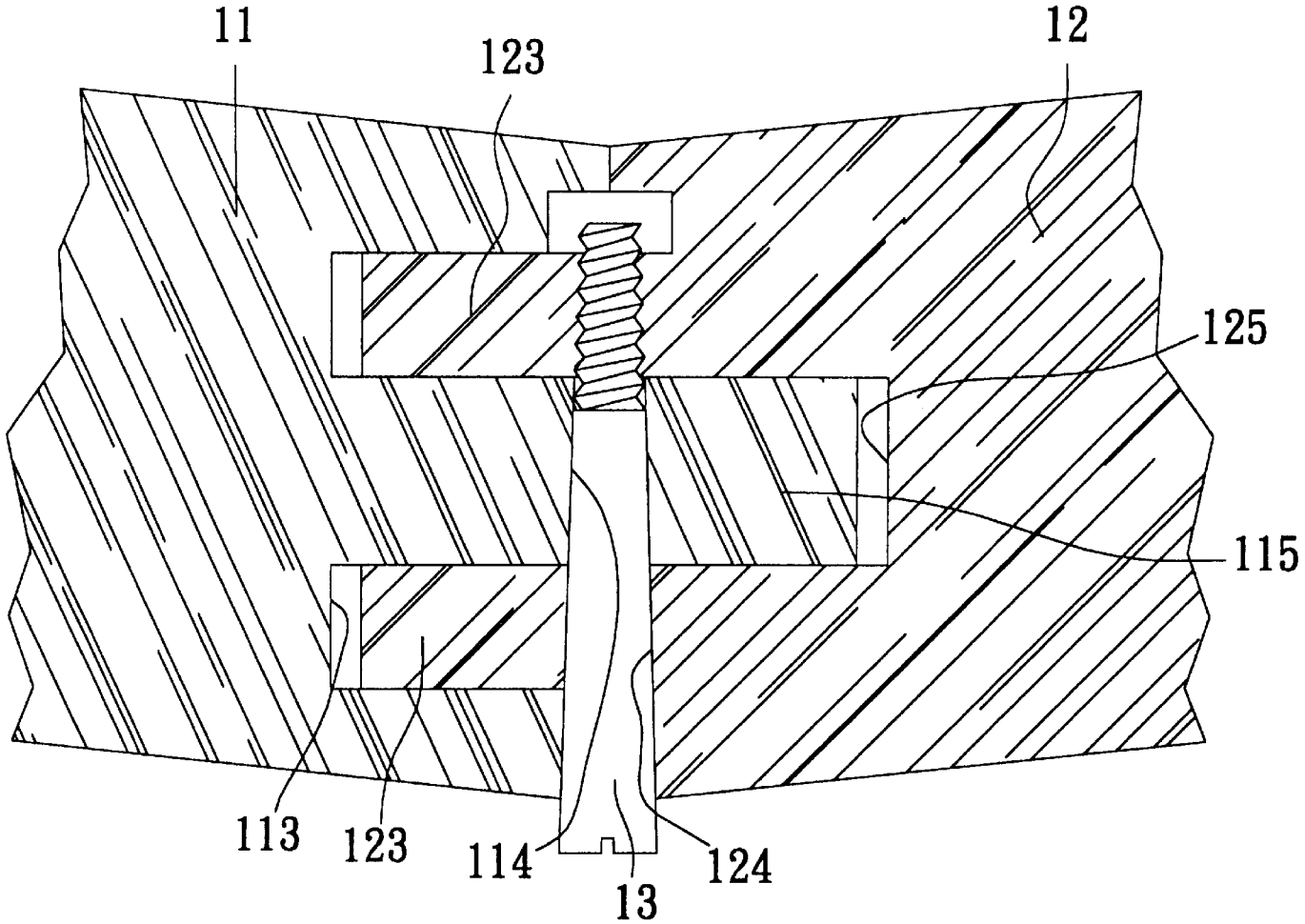
FIG. 3 is a sectional assembled view of the main wing of the present invention.
Figure 4:
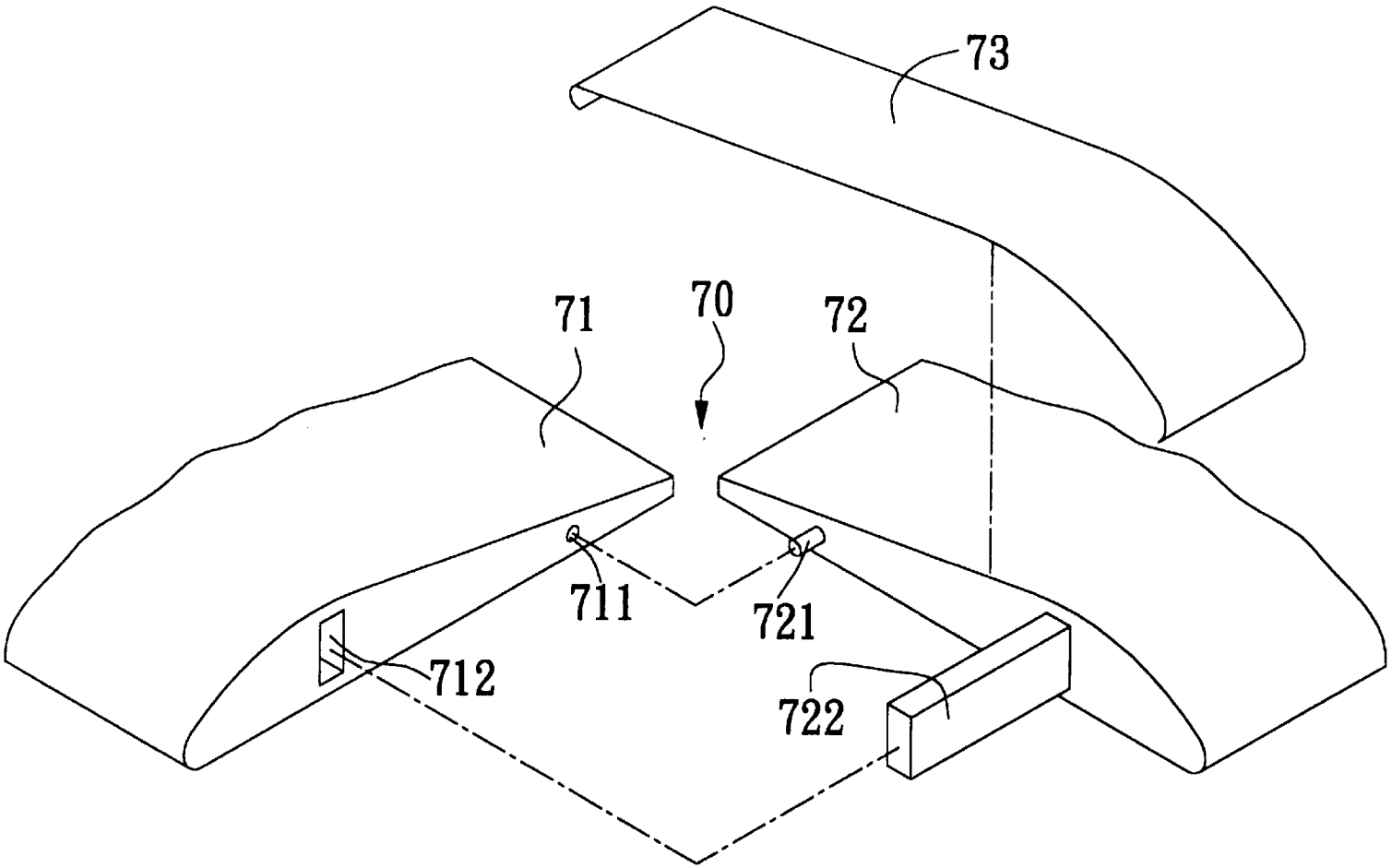
PRIOR ART FIG. 4
FIG. 4 is a perspective exploded view of the main wing of a conventional model airplane.

Please refer to FIGS. 1 to 3. The main wing 10 of the present invention is composed of a left wing 11 and a right wing 12. The mating face of the right wing 12 is disposed with a connecting post 121 and an upper reverse angle connecting plate 122. The left wing 11 is formed with a connecting socket 111 and a connecting way 112 corresponding to the connecting post 121 and the connecting plate 122.

The front section of the mating face of the right wing 12 is disposed with a projecting engaging seat 123. The engaging seat 123 is formed with a perpendicular conic hole 124 passing through the bottom face of the right wing 12. A middle portion of the engaging seat 123 is formed with an engaging recess 125 parallel to the wing face.

The left wing 11 is formed with a receptacle 113 corresponding to the engaging seat 123 of the right wing 12. In addition, the left wing 11 is formed with a projecting engaging block 115 corresponding to the engaging recess 125 of the engaging seat 123 of the right wing 12. The engaging block 115 is formed with a conic hole 114 corresponding to the conic holes 124 of the engaging seat 123 and having equal coning. The conic hole 114 passes through the bottom face of the left wing 11, whereby when the left and right wings are mated with each other, a conic screw 13 can be screwed into the conic holes 124 and 114 to lock the left wing 11 with the right wing 12.

The engaging seat 123 and the engaging block 115 are made of relatively hard wood material so that after the engaging seat 123 and the engaging block 115 are respectively engaged in the receptacle 113 and the engaging recess 125, the conic holes 124 and 114 with equal coning will communicate with each other. An aluminum-made screw 13 can be screwed thereinto to firmly fix the engaging seat 123 and engaging block 115 and firmly associate the left wing 11 and the right wing 12 to form the main wing 10. When disassembling the main wing 10, the screw 13 is untightened to quickly disassemble the left wing 11 from the right wing 12 for easy carriage or storage. When tightening the screw 13, the coning thereof can accurately tighten the conic holes 124 and 114. When untightened, the coning thereof permits the screw 13 to be quickly untightened.

The above embodiment is only used to illustrate the present invention, not intended to limit the scope thereof Many modifications of the above embodiment can be made without departing from the spirit of the present invention.

What is claimed is:

1. An assembly structure for the main wing of a model airplane comprising:

a main wing assembly having a left wing and a right wing, said right wing having a mating face, said mating face having a connecting post and an upper reverse angle connecting plate projecting therefrom, said left wing having a connecting socket and a connecting way formed therein in aligned relation with said connecting post and said upper reverse angle connecting plate, said mating face of said right wing having a front section, said front section having a projecting engaging seat, said projecting engaging seat having a perpendicular conic hole formed therethrough and passing through a bottom face of said right wing, said projecting engaging seat defining a middle portion having an engaging recess formed therein, said engaging recess being positioned substantially perpendicular to said mating face, said left wing being formed with a receptacle corresponding to said projecting engaging seat of said right wing, said left wing having a projecting engaging block formed therein corresponding to said engaging recess of said projecting engaging seat of said right wing, said engaging block having a block conic hole formed therein corresponding to said perpendicular conic hole of said projecting engaging seat, said block conic hole and said perpendicular conic hole having substantially equal dimensions, said block conic hole passing through a left bottom face of said left wing; and, a conic screw threaded into said perpendicular and block conic holes to lock said left wing to said right wing when said left and right wings are mated with each other.

2. An assembly structure for the main wing of a model airplane as recited in claim 1, wherein said screw is formed of an aluminum material.

* * * * *